United States Patent [19]

Teerman

[11] Patent Number: 4,540,122

[45] Date of Patent: Sep. 10, 1985

[54] ELECTROMAGNETIC UNIT FUEL INJECTOR WITH PIVOTABLE ARMATURE

[75] Inventor: Richard F. Teerman, Wyoming, Mich.

[73] Assignee: General Motors Corporation, Detroit, Mich.

[21] Appl. No.: 545,449

[22] Filed: Oct. 26, 1983

[51] Int. Cl.[3] ..... F02M 49/00; F02M 55/00

[52] U.S. Cl. ..... 239/88; 239/585

[58] Field of Search ..... 294/88, 89, 90, 91, 294/95, 585, 124; 251/30, 45, 141, 139

[56] References Cited

U.S. PATENT DOCUMENTS

| | | | |
|---|---|---|---|
| 4,390,130 | 6/1983 | Linssen et al. | 239/585 |
| 4,418,886 | 12/1983 | Holzer | 251/30 |
| 4,463,900 | 8/1984 | Wich | 239/88 |

*Primary Examiner*—James B. Marbert

*Attorney, Agent, or Firm*—Arthur N. Krein

[57] ABSTRACT

An electromagnetic unit fuel injector for use in a diesel engine includes a housing having a bushing with an externally actuated plunger reciprocable therein to define a pump chamber open at one end for the discharge of fuel to a spring biased, pressure actuated fuel injection nozzle. The pump chamber is connected to a supply/spill chamber means via flow-through solenoid with pivot armature actuated, normally open, hollow pressure sensitive valve to permit the ingress and egress of fuel. The supply/spill chamber means adjacent to the head of the valve is in flow communication with a source of fuel at a relatively low supply pressure. During a pump stroke of the plunger, the solenoid can be energized, as desired, to effect pivotal movement of the pivot armature located so as to axially push the pressure sensitive valve to a closed position relative to an associate valve seat whereby to block flow from the pump chamber to the supply/spill chamber means, thus allowing the plunger to effect pressurization of the fuel so as to effect discharge of fuel from the injection nozzle.

3 Claims, 2 Drawing Figures

ELECTROMAGNETIC UNIT FUEL INJECTOR WITH PIVOTABLE ARMATURE

This invention relates to unit fuel injectors of the type used to inject fuel into the cylinders of a diesel engine and, in particular, to an electromagnetic unit fuel injector having a solenoid with pivotable armature controlled valve therein.

DESCRIPTION OF THE PRIOR ART

Unit fuel injectors, of the so-called jerk type, are commonly used to pressure inject liquid fuel into an associate cylinder of a diesel engine. As is well known, such a unit injector includes a pump in the form of a plunger and bushing which is actuated, for example, by an engine driven cam whereby to pressurize fuel to a suitable high pressure so as to effect the unseating of a pressure actuated injection valve in the fuel injection nozzle incorporated into the unit injector.

In one form of such a unit injector, the plunger is provided with helices which cooperate with suitable ports in the bushing whereby to control the pressurization and therefore the injection of fuel during a pump stroke of the plunger.

In another form of such a unit injector, a solenoid valve is incorporated in the unit injector so as to control, for example, the drainage of fuel from the pump chamber of the unit injector. In this latter type injector, fuel injection is controlled by the energization of the solenoid valve, as desired, during a pump stroke of the plunger whereby to terminate drain flow so as to permit the plunger to then intensify the pressure of fuel to effect unseating of the injection valve of the associated fuel injection nozzle. An exemplary embodiment of such an electromagnetic unit fuel injector is disclosed, for example, in U.S. Pat. No. 4,129,253 entitled Electromagnetic Unit Fuel Injector issued Dec. 12, 1978 to Ernest Bader, Jr. John I. Deckard and Dan B. Kuiper.

In the U.S. Pat. No. 4,392,612, entitled Electromagnetic Unit Fuel Injector, issued July 12, 1983, in the names of John I. Deckard and Robert D. Straub, there is disclosed a unit injector wherein a normally open, pull-type solenoid actuated, pressure balanced, control valve is used to control the drain flow of fuel from the pump chamber during a pump stroke of the associate plunger, and in copending U.S. patent application Ser. No. 457,417, entitled Electromagnetic Unit Fuel Injector, filed Jan. 12, 1983, now U.S. Pat. No. 4,463,900 issued Aug. 7, 1984 to Thomas J. Wich and assigned to a common assignee, there is disclosed a somewhat similar type unit injector but with a solenoid actuated non-pressure balanced, control valve to control such drain flow. Fuel injection is initiated by energization of the solenoid to block drain flow of fuel from the pump chamber, thus allowing the continued plunger movement to intensify the pressure of fuel to a value to effect unseating of an associated pressure actuated injection valve. Upon deenergization of the solenoid, a valve spring effects unseating of the control valve allowing the fuel pressure to drop and thereby to terminate injection.

In both of the above type unit injectors the armature of the solenoid assembly is used to effect closing movement of the control valve is of conventional flat configuration and is positioned so as to move as a unit relative to an associated fixed pole piece of the solenoid assembly.

SUMMARY OF THE INVENTION

The present invention provides an electromagnetic unit fuel injector that includes a pump assembly having a plunger reciprocable in a bushing and externally operated as, for example, by an engine driven rocker arm, with flow from the pump chamber during a pump stroke of the plunger being directed to a fuel injection nozzle assembly of the unit that contains a spring biased, pressure actuated injection valve therein for controlling flow out through the spray tip outlets of the injection nozzles. Fuel from the pump chamber can also flow through a passage means, containing a normally open, solenoid actuated, hollow, control valve means to a chamber containing fuel as at a relatively low supply pressure. Fuel injection is regulated by the controlled energization of the solenoid actuated control valve so that the valve is operatively positioned to block drain flow from the pump during a pump stroke of the plunger whereby the plunger is then permitted to intensify the pressure of fuel to a value to effect unseating of the injection valve. The control valve means is positioned so as to be operable by a fulcrumed armature of the solenoid assembly which is arranged so that the magnetic force attracting the armature to the associate pole piece is amplified to effect closing movement of the control valve.

It is therefore a primary object of this invention to provide an improved electromagnetic unit fuel injector that contains an improved solenoid assembly with pivoting armature to effect closing movement of a control valve means therein used for controlling the start and end of injection.

Another object of this invention is to provide an improved electromagnetic unit fuel injector that contains a solenoid actuated valve controlling spill flow during a pump stroke, the solenoid having a stator assembly that includes a fixed pole piece with an armature that is pivotable about a fixed element of the stator assembly so as to operate as a lever to effect closing movement of the valve with a force greater than the available attractive force applied by the pole piece upon the armature, thus permitting a smaller solenoid assembly to be used in a given unit injector application.

Still another object of the present invention is to provide an electromagnetic unit fuel injector of the above type which includes features of construction, operation and arrangement, rendering it easy and inexpensive to manufacture and assemble, which is reliable in operation and in other respects suitable for use in production motor vehicle fuel systems.

For a better understanding of the invention, as well as other objects and further features thereof, reference is had to the following detailed description of the invention to be read in connection with the accompanying drawings.

DESCRIPTION OF THE PREFERRED EMBODIMENT

Figure 1:
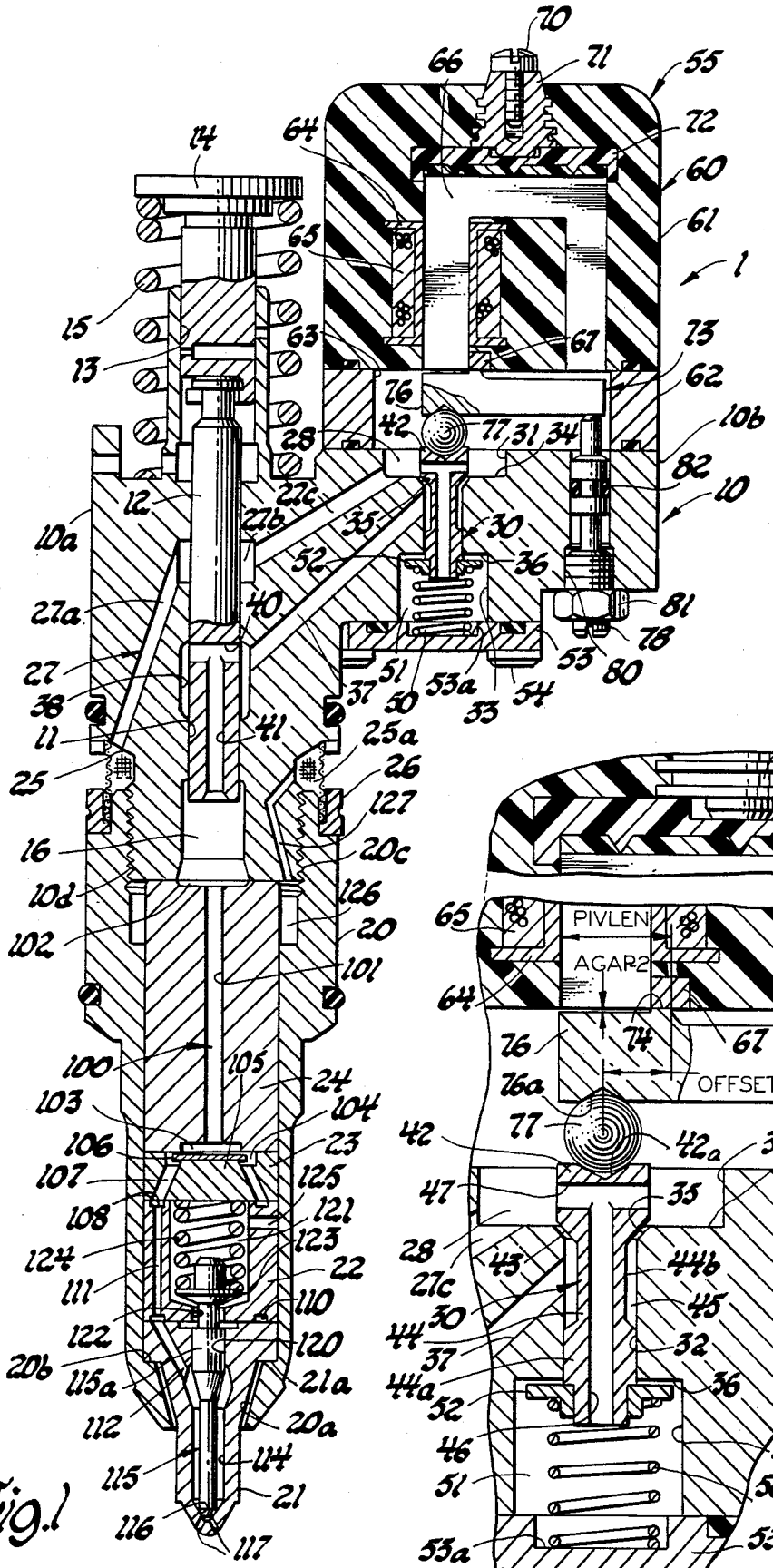
FIG. 1 is a longitudinal sectional view of an electromagnetic unit fuel injector in accordance with a preferred embodiment of the invention, with elements of the injector being shown so that the plunger of the pump thereof is positioned at near the beginning of a pump stroke and with the electromagnetic valve means thereof deenergized, and with parts of the unit shown in elevation; and, FIG. 2 is an enlarged schematic view of a portion of the solenoid/armature and valve, per se, of the injector of FIG. 1.

Referring first to FIG. 1, there is shown an electromagnetic unit injector 1 constructed in accordance with a preferred embodiment of the invention. This injector 1 is, in effect, a unit fuel injector-pump assembly with an electromagnetic actuated, normally open, control valve incorporated therein to control fuel discharge from the injector portion of this assembly in a manner to be described. As is well known in the art, the unit injector is adapted to be mounted in a suitable injector socket provided in the cylinder head, both not shown, of a diesel engine. In the embodiment shown, the unit injector is also adapted so that fuel can be supplied to or drained from the unit injector via an internal supply/-drain gallery, not shown, provided for this purpose in the cylinder in a manner well known in the art.

In the construction illustrated, the electromagnetic unit fuel injector 1 includes an injector body 10 which is defined by a vertical main body portion 10*a* and an integral side body portion 10*b*. The body portion 10*a* is provided with a vertical extending stepped bore therethrough defining a lower cylindrical wall or bushing 11 of an internal diameter to slidably and sealingly receive a pump plunger 12 and an upper wall 13 of a larger internal diameter than that defining the bushing. An actuator follower 14 abuts against the upper outboard portion of the plunger 12, whereby it and the plunger thus operatively connected thereto are adapted to be reciprocated, for example, by an engine driven rocker arm, not shown, in a known manner. A plunger return spring 15 is operatively connected to the plunger 12 to normally bias it in a suction stroke direction.

The pump plunger 12 forms with the bushing 11 a variable volume pump chamber 16 at the lower open end of the bushing 11.

In a conventional manner, a nut 20 is threaded to the lower end of the body 10 to form an extension thereof. Nut 20 has an opening 20*a* at its lower end through which extends the lower end of a combined injector valve body or spray tip 21, hereinafter referred to as the spray tip, of a conventional fuel injection nozzle assembly. As shown, the spray tip 21 is enlarged at its upper end to provide a shoulder 21*a* which seats on an internal shoulder 20*b* provided by the through counterbore in nut 20. Between the spray tip 21 and the lower end of the injector body 10 there is positioned, in sequence starting from the spray tip, a spring cage 22, a spring retainer 23 and a director cage 24, these elements being formed, in the construction illustrated, as separate elements for ease of manufacturing and assembly. Nut 20 is provided with internal threads 20*c* for mating engagement with the external threads 10*d* at the lower end of body 10. The threaded connection of the nut 20 to body 10 holds the spray tip 21, spring cage 22, spring retainer 23 and director cage 24 clamped and stacked end-to-end between the upper face 21*b* of the spray tip 21 and the bottom face of body portion 10*a*. All of these above-described elements have lapped mating surfaces whereby they are held in pressure sealed relation to each other.

In the construction shown in FIG. 1, the main body portion 10*a* is provided with an annular groove 25 next adjacent to the upper end of the nut 20 that is encircled by an annular fuel filter assembly 26 to define a fuel chamber 25*a* that would be in flow communication with the fuel supply/drain gallery previously described and with the lower end of a passage 27 provided in the body 10. As shown, passage 27 includes a passage portion 27*a*, an annular chamber 27*b* encircling the plunger 12 and a passage portion 27*c*, the opposite end of this latter passage portion 27*c* opening into a supply/drain chamber 28 to be described in detail hereinafter.

Fuel flow between this supply/drain chamber 28 and the pump chamber 16 is controlled by a normally open, control valve 30 actuated by a solenoid, generally designated 55, constructed in accordance with the invention.

For this purpose, the side body portion 10*b* is also provided with a stepped bore therethrough to define circular internal walls including an upper wall 31, an intermediate valve stem guide wall 32 and a lower wall 33. Walls 33 and 31 are of larger internal diameters than that of guide wall 32. Walls 32 and 31 are interconnected by a flat shoulder 34 and an inclined wall defining an annular conical valve seat 35 encircling wall 32. Walls 32 and 33 are interconnected by a flat shoulder 36.

The actual ingress and egress of fuel to the pump chamber 16 is by means of an inclined passage 37 provided in body 10. As shown, the lower end of this passage 37 opens into an annular groove 38 provided in bushing 11 while the upper end thereof opens through the valve stem guide wall 32 in the side body portion 10*b* at a location to permit direct drilling of this passage.

Actual flow communication between this passage 37 and the pump chamber 16 via the groove 38 is by means of at least one radial passage 40 and an interconnecting axial passage 41 provided in the lower end of the plunger 12. As best seen in FIG. 1, the axial extent of the groove 38 is such that the radial passage 40 will be in flow communication therewith during the full operational reciprocation of the plunger 12.

The control valve 30, in the construction shown is in the form of a poppet valve that includes a head 42 with a conical valve seat surface 43 thereon and with a stem 44 depending therefrom. The stem 44 includes a lower portion 44*a* of diameter to be reciprocably received in the valve stem guide wall 32 and an upper portion 44*b* of reduced diameter next adjacent to the head 42 and of an axial extent so as to form with the valve stem guide wall 32 an annulus cavity 45 that is in communication with the passage 37 during opening and closing movement of the valve 30. In the construction shown in FIG. 1, the valve 30 is provided with an axial bore 46 that extends through the stem 44 so as to intersect at least one radial bore 47 in the head 42, for a purpose to be described hereinafter.

Preferably, and as shown in the illustrated embodiment, the valve 30 is an unbalanced pressure valve of the type disclosed in the above-identified U.S. patent application Ser. No. 457,417, the disclosure of which is incorporated herein by reference thereto. However, as will be apparent to those skilled in the art, other forms of valves may be used. For example, a balanced pressure valve of the type disclosed in the above-identified U.S. Pat. No. 4,392,612 or a suitable needle valve may be used in lieu of the valve 30 shown.

Figure 2:
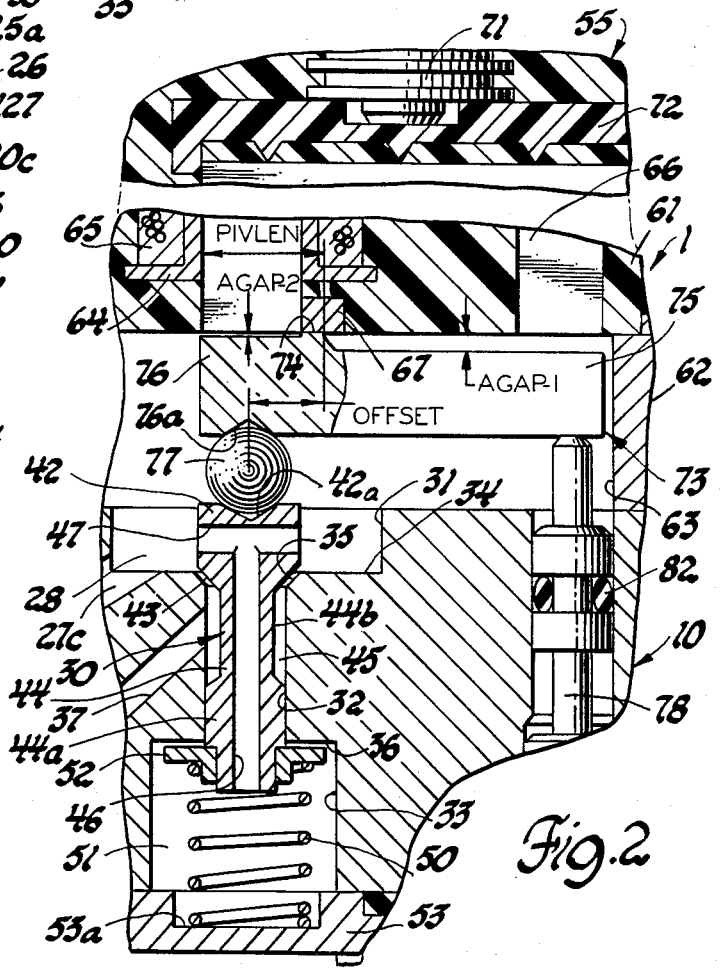

Valve 30 is normally biased to a valve open position, the position shown in FIG. 2, by means of a valve spring 50 loosely received in a spring chamber 51 defined in part by the bore wall 33, and shoulder 36 in the side body portion 10*b*. One end of the spring 50 abuts against a spring retainer 52 suitably fixed to the lower stem end of the valve. The opposite end of the spring 50 abuts against a recessed shoulder 53*a* in a cap 53 suitably secured, as by cap screws 54, to the lower surface of the side body portion 10*b* whereby to sealingly enclose the lower end of the spring chamber 51.

Movement of the valve 30 in a valve closing direction, downward with reference to FIGS. 1 and 2, is by means of the solenoid assembly 55 constructed in accordance with the invention.

In the construction illustrated, the solenoid assembly 55 includes a stator assembly, generally designated 60, having a flanged solenoid case 61, made of a suitable plastic, such as glass-filled nylon, which is suitably secured as by screws, not shown, to the upper surface of the side body portion 10*b*, with a ring like, solenoid spacer 62 of predetermined thickness sealingly sandwiched therebetween, in a position so that the rectangular opening 63 through the solenoid spacer 62 encircles the bore wall 31 whereby to define therewith the supply/drain chamber 28.

A coil bobbin 64, supporting a wound solenoid coil 65 and a laminated U-shaped pole piece 66 are supported within the solenoid case 61 in a position so that one leg of the pole piece 66, the left hand leg with reference to FIGS. 1 and 2, is located over the head of the valve 30. In the construction shown, a bearing insert 67, of suitably hard, non-magnetic material, is also supported in the solenoid case 60 between the legs of the pole piece 66 in a position next adjacent to the left leg of the pole piece.

The solenoid coil 65 is connected, by electrical conductors, not shown, that are adapted to be attached, as by screws 70 to a pair of internally threaded terminal leads 71, only one screw and terminal being shown in FIG. 1, to a suitable source of electrical power via a fuel injection electronic control circuit, not shown, whereby the solenoid coil 65 can be energized as a function of the operating conditions of an engine in a manner well known in the art. As shown, the terminal leads 71 have these lower ends electrically separated from the upper end of the pole piece 66 by an insulator plate 72 made of a suitable electrical insulating material.

Preferably as shown in FIG. 1, the pole piece 66, bobbin 64, solenoid coil 65, bearing insert 67, insulator 72, and the terminal leads 71 are assembled as shown and are then encapsulated by the plastic material of the solenoid case 61, during the manufacture of this plastic encapsulated stator assembly. Thus, as shown, only the lower surfaces of the legs of the pole piece 66 and of the bearing insert 67 and, of course, the upper end of the terminal leads 71 are not enclosed by the plastic material of the solenoid case 61. These exposed surfaces of the pole piece 66 on bearing insert 67, preferably as shown, lie in the same plane as the bottom surface of the solenoid case 61.

Now in accordance with a feature of the invention, the armature 73 of the solenoid assembly 55 is, in effect, in the form of a rocker arm of rectangular configuration and with a structural arrangement whereby it is supported for pivotable movement as fulcrumed about a transverse pivot line contact between a pivot edge of its upper surface and the lower surface of the fixed bearing insert 67.

The armature 73, in the embodiment shown, includes an intermediate portion providing on its upper surface a pivotable bearing member 74 for pivotable engagement with the bearing insert 67 and with a lever or drive arm 75 and a lever or driven arm 76 on opposite sides of this intermediate portion 74 to cooperate with the pole piece 66 and valve 30, respectively.

As best seen in FIG. 2, the upper surface of the armature drive arm 75 is recessed a predetermined distance relative to the bearing member 74 so that when the armature is positioned in a valve open position, the position shown in the Figures, a predetermined working air gap AGAP-1 will exist between this working surface of the armature and the opposed working surface of the right leg of the pole piece 66, with reference to the Figures. This working air gap AGAP-1 is preferably preselected relative to the stroke of the valve 30, moving from its open position shown to its closed position, so that a predetermined mean minimum air gap will exist between these opposed working surfaces when the armature is fully pivoted, counterclockwise with reference to the Figures, to effect valve closing.

Preferably, as best seen in FIG. 2, the upper surface of the driven arm 76 is also recessed a predetermined distance, as desired, in the area where it underlies the other leg of the pole piece 66 so as to provide an air gap AGAP-2 between this surface and the opposed surface of the left leg of the pole piece, with reference to this Figure. This air gap AGAP-2 is predetermined as a function of the ratio of the lengths of the arms 75, 76 so as to permit movement of the drive arm 75 toward the associate leg of the pole piece 66, as described in greater detail hereinafter.

As should now be apparent, with this arrangement, the armature 73 is pivotable about the transverse edge of the bearing member 74, located next adjacent to the recessed portion of the armature arm 75. This pivot edge is located a predetermined distance PIVLEN (pivot length) from the outboard end of the left leg of the pole piece 66 and is thus offset a predetermined distance OFFSET from the reciprocating axis of the valve 30.

As shown, a valve actuator in the form of a ball 77 of predetermined diameter is interposed between the valve 30 and the driven arm 76 of the armature 66. Preferably, both the upper surface of the head 42 of valve 30 and the lower surface of the driven arm 76 are provided with shallow ball receiving sockets 42*a* and 76*a*, respectively, to effect operative retention of the ball.

In order to prevent pivotable movement of the armature 73 in a clockwise direction, with reference to the valve open position shown in FIG. 2, an adjustable stop screw 78 made, for example, of a nonmagnetic material, is threadingly received in the vertical stepped, internally threaded bore 80 provided in the side body portion 10*b* and axially locked by means of a lock nut 81. As illustrated, bore 80 is located so as to permit the upper end of the stop screw 78 to extend into the supply/drain chamber 28 whereby it can abut against the lower surface of the armature drive arm 75. An O-ring seal 82 is located in an annular groove provided in the unthreaded shank portion of the stop screw 78 to effect a fluid seal between this stop screw and the internal straight wall of bore 80.

In a particular application, for example, the pole piece 66 had a laminated stack depth of 19 mm, a leg width of 5 mm and, a window width of 11 mm between these legs. Accordingly in this application, the armature 73 was 21 mm in length and 19 mm wide, the working air gap AGAP-1 was 0.60 mm, the air gap AGAP-2 defined by the recessed surface of the driven arm 76 was at least 0.05 mm so as to substantially reduce hydraulic stiction, the pivot length PIVLEN was 6 mm, the offset OFFSET was 4 mm and the mean length ratio of arms 75 and 76 was 3.5:1. In this application the valve 30 had a stroke length of 0.15 mm in its movement between its full open and closed positions and the associated actuator ball 77 had a diameter of 4 mm.

Since an armature is normally made of magnetically soft material which is generally correspondingly physically soft, in order to prevent excessive wear of the bearing member 74 the upper surface of the intermediate portion of the armature 73 defining this bearing member 74 is perferably made of a suitable hard, wear resistant material. This wear resistant material can be provided by surface hardening the upper surface of the intermediate portion of the armature 73 defining the bearing member 74 in a suitable manner, as disclosed for example in U.S. Pat. No. 4,231,525 entitled Electromagnetic Fuel Injector with Selectively Hard Armature, issued Nov. 4, 1980 to James D. Palma. Alternatively, the bearing member 74 can be formed as a separate insert of suitable wear resistant material that is then secured to the body of the armature 73, as by welding.

During operation, on a pump stroke of plunger 12, pressurized fuel is adapted to be discharged from pump chamber 16 into the inlet end of a discharge passage means 100 to be described next hereinafter.

An upper part of this discharge passage means 100, with reference to FIG. 1, includes a vertical passage 101 extending from an upper recess 102 through director cage 24 for flow communication with an annular recess 103 provided in the lower surface of director cage 24.

As shown in FIG. 1, the spring retainer 23 is provided with an enlarged chamber 104 formed therein so as to face the recess 103 and, projecting upwardly from the bottom of the chamber 104 is a protuberance 105 which forms a stop for a circular flat disc check valve 106. The chamber 104 extends laterally beyond the extremities of the opening defining recess 103 whereby the lower end surface of the director cage 24 will form a seat for the check valve 106 when in a position to close the opening defined by recess 103.

At least one inclined passage 107 is also provided in the spring retainer 23 to connect the chamber 104 with an annular groove 108 in the upper end of spring cage 22. This groove 108 is connected with a similar annular groove 110 on the bottom face of the spring cage 22 by a longitudinal passage 111 through the spring cage. The lower groove 110 is, in turn, connected by at least one inclined passage 112 to a central passage 114 surrounding a needle valve 115 movably positioned within the spray tip 21. At the lower end of passage 114 is an outlet for fuel delivery with an encircling annular conical valve seat 116 for the needle valve 115 and, below the valve seat 116 are connecting spray orifices 117 in the lower end of the spray tip 21.

The upper end of spray tip 21 is provided with a bore 120 for guiding opening and closing movement of the needle valve 115. The piston portion 115*a* of the needle valve slidably fits this bore 120 and has its lower end exposed to fuel pressure in passage 114 and its upper end exposed to leakage fuel pressure in the spring chamber 121 via an opening 122, both being formed in spring cage 22. A reduced diameter upper end portion of the needle valve 115 extends through the central opening 122 in the spring case and abuts a spring seat 123. Compressed between the spring seat 123 and spring retainer 23 is a coil spring 124 which normally biases the needle valve 115 to its closed position shown.

In order to prevent any tendency of fuel pressure to build up in the spring chamber 121, this chamber is vented through a radial port passage 125. While a close fit exists between the nut 20 and the spring cage 22, spring retainer 23 and director cage 24, there is sufficient diametral clearance between these parts for the venting of fuel back to a relatively low pressure area to be described in detail hereinafter.

In the construction illustrated, this fuel is drained into a cavity 126 defined by the internal wall of the nut 20 and the upper end of director cage 24 and from this cavity fuel is returned to the chamber 25*a* via a drain passage 127 provided for this purpose in the lower end of the main body portion 10*a*.

FUNCTION DESCRIPTION

During engine operation, fuel is supplied at a predetermined supply pressure by a pump, not shown, to the subject electromagnetic unit fuel injector 1 through a supply conduit, not shown, provided in the cylinder head and through a port, both not shown, into the chamber 25*a*. Fuel thus admitted flows through the passage 27 into the supply/spill chamber 28. Fuel at this supply pressure can also flow through the port 47 and bore 46 of the hollow valve 30 into the spring chamber 31.

With the solenoid coil 65 of solenoid 55 deenergized, and with the valve spring 50 being of a suitable force it is operative to open and hold open the valve 30 relative to the valve seat 35. At the same time, the armature 73 operatively connected to the valve 30 by the actuator ball 77 is moved to a substantially parallel position relative to pole piece 66, the position shown in the Figures, whereby a predetermined working air gap AGAP-1 is established between the opposed working surfaces of the armature arm 75 and pole piece 66, as previously described.

Thus during a suction stroke of the plunger 12, with the valve 30 then in its open position, fuel can now flow from the supply/spill chamber 28 through the annulus passage, now defined by the clearance between the valve seat surface 43 and valve seat 35, into the chamber 45 defined by the reduced diameter upper valve stem portion 44*b* and then via passage 37 into the cavity defined by groove 38 and then through passages 40 and 41 into the pump chamber 16. At the same time, fuel will be present in the discharge passage means 100 used to supply fuel to the injection nozzle assembly.

Thereafter, as the follower 14 is driven downward, to effect a pump stroke of the plunger 12, that is downward movement of the plunger 12 with reference to FIG. 1, this downward pump stroke movement of the plunger will cause pressurization of the fuel within the pump chamber 16 and of course of the fuel in the passages 37 and 100 associated therewith. However, with the solenoid coil 65 still deenergized, this pressure can only rise to a level that is a predetermined amount less than the "pop" pressure required to lift the needle valve 115 against the force of its associate return spring 124.

During this period of time, the fuel displaced from the pump chamber 16 can flow via the passages 41, 40, the cavity defined by annular groove 38 and passage 37 back to the supply/spill chamber 28 since valve 30 is still open.

Thereafter, during the continued downward stroke of the plunger 12, an electrical (current) pulse of finite character and duration (time relative for example to the top dead center of the associate engine piston position with respect to the camshaft, not shown, and rocker arm linkage) applied through suitable electrical conductors to the solenoid coil 65 produces an electromagnetic field attracting the armature arm 75 upward, from the position shown, toward the opposed leg of the pole piece 66 causing the armature 73 to pivot about the line of contact between the pivot member 74 and the fixed bearing insert 67.

This pivotable movement of the armature 73 as coupled by the actuator ball 77 to the valve 30 will effect its seating against the associate valve seat 35. As this occurs, the drainage of fuel from the pump chamber 18 via passage 37 in the manner described hereinabove will no longer occur. Without this spill of fuel from the pump chamber 16, the continued downward movement of the plunger 12 will increase the pressure of fuel therein to a "pop" pressure level to effect unseating of the needle valve 115. This then permits the injection of fuel out through the spray orifices 117. Normally, the injection pressure continues to build up during further continued downward movement of the plunger 12.

It will be appreciated that when the solenoid coil 65 is energized, the magnetic flux density will be about the same through both air gaps, neglecting the fringe effect of the magnetic fields, since the pole piece 66 and the armature 73 are, in effect, in a series circuit. Accordingly, although the attractive force would be about the same on both arms 75 and 76, the force acting on the drive arm 75 which is substantially longer than driven arm 76 will result in movement of this portion of the armature 73 toward the right leg of the pole piece 66 to effect pivotal movement of the armature about its pivot edge in a counterclockwise direction with reference to the Figures.

Because of the lever arm ratio of 3.5:1 of the arms 75, 76 in the application described, the force applied by the driven arm 76 to move and hold valve 30 in its closed position will be substantially greater than the attractive force between the opposed working surfaces of the pole piece 66 and the drive arm 75 of the armature.

Ending the application of electrical current pulse to the solenoid coil 65 causes the electromagnetic field to collapse to a level at which the electromagnetic force acting on the valve 30 (through the armature 73 acting as a lever) is less than the hydraulic force plus the spring 50 force on the valve 30. As this occurs, the force of the valve spring 50 together with the hydraulic force causes immediate unseating of the valve 30 so as to allow spill fuel flow from the pump chamber 16 via the passages including passage 37 back to the supply/spill chamber 28. The hydraulic force is caused by the fact that the actual valve seating diameter of the unbalanced pressure valve 30 is slightly larger than the valve guide diameter of bore wall 32, resulting in a small differential area for the injection pressure to work against.

This spill flow of fuel thus releases the injection nozzle system pressure as in the discharge passage means 100 so that the spring 124 can again effect seating of the valve 115 to thus terminate injection. Of course, as the valve 30 is thus opened, the armature 73 via its actuator ball 77 connection with the valve 30 will again be moved to its deenergized position, the position shown in the Figures, against the stop screw.

Referring now to the solenoid 55 and armature 73 assembly in accordance with the invention, it should be appreciated that the magnetic circuit thereof is, in effect, made up of four reluctances in series, that is, the core or pole piece 66, armature 73 and the two air gaps AGAP 1 and AGAP 2. The magnetic flux, neglecting flux fringing, in this circuit is equal through each air gap because of this series configuration and, the flux densities in these air gaps are also equal because the area is the same for both air gaps. Therefore, again neglecting flux fringing, the forces at each of the air gaps are equal.

Accordingly, if the pivot point of the armature 73 is offset either way from the center, this pivot point being offset to the left of center in the embodiment shown, these magnetic tractive forces will form a net torque on the armature 73 and accelerate the entire control valve 30 train or produce a static force on it.

However, as is well known, flux fringing effectively causes the effective air gap areas to become a function of the lengths of the air gaps. A larger air gap will produce a larger effective area if the actual area is held constant and, of course, the magnetic tractive force will be less for a larger air gap effective area. Accordingly, by proper selection of the pivot point location to provide a suitable lever arm ratio, a desired torque can be produced on a pivot armature even if the air gaps are not equal in length.

Thus it should now be apparent to those skilled in the art that the undercut or recessed surface of the driven arm 76 is preselected so as to provide a suitable air gap to prevent hydraulic stiction when the armature 73 is moved to the position shown, this air gap also being preselected as a function of the lever arm ratio whereby to permit the desired pivotable movement of the pivot armature.

It will also now be appreciated that, if desired, a shim, not shown, of suitable non-magnetic material of predetermined thickness, as desired, can be suitably secured either to a recessed surface of the armature or to the lower end of an associate leg of the pole piece to define, in effect, a minimum fixed air gap between these opposed working surfaces.

While the invention has been described with reference to the structure disclosed herein, it is not confined to the specific details set forth, since it is apparent that many modifications and changes can be made by those skilled in the art. For example, separate inlet supply and drain passages may be used and these can be of the external type as used on mechanical unit injectors. This application is therefore intended to cover such modifications or changes as may come within the purposes of the improvements or scope of the following claims.

The embodiments of the invention in which an exclusive property or privilege is claimed are defined as follows:

1. An electromagnetic unit fuel injector of the type including a pump means to pressurize fuel; a supply/-spill passage means in flow communication with said pump means and having a valve operatively associated therewith for movement between an open position and a closed position to control flow therethrough, a spring means operatively associated with said valve to normally bias said valve to said open position and, a solenoid means including a fixed pole piece means and a movable armature operatively associated with said valve to effect movement thereof to said closed position: the improvement wherein said armature is in the form of a rocker arm and includes a first lever arm portion operatively associated with said valve, an intermeidate fulcrum portion pivotally positioned in abutment against a fixed element of said pole piece means and a second lever arm portion, of a length greater than said first arm portion, operatively positioned a predetermined distance from said pole piece means whereby upon energization of said pole piece means, said second lever arm is attracted to said pole piece means to effect movement of said valve to said closed position via said first lever arm, by a force greater than the attractive force applied by the said solenoid pole piece means upon said second lever arm portion as multiplied by the effective respective lengths of said second lever arm portion relative to said first lever arm portion.

2. An electromagnetic unit fuel injector of the type including a pump means to pressurize fuel; a supply/-spill passage means in flow communication with said pump means and having a valve operatively associated therewith for movement between an open position and a closed position to control flow therethrough, a spring means operatively associated with said valve to normally bias said valve to said open position and, a solenoid means including a fixed pole piece means and a movable armature operatively associated with said valve to effect movement thereof to said closed position: the improvement wherein said pole piece means includes a U-shaped core having spaced apart legs the free ends of which define working surface of equal areas and wherein said armature is in the form of a rocker arm and includes a first lever arm portion operatively associated with said valve, an intermediate fulcrum portion pivotally positioned in abutment against a fixed element of said pole piece means and a second lever arm portion, of a length greater than said first arm portion, said first and second lever arm portions defining spaced apart working surfaces opposed predetermined distances from said working surfaces of said core of said pole piece means whereby upon energization of said pole piece means, said second lever arm is attracted to said core to effect movement of said valve to said closed position via said first lever arm, by a force greater than the attractive force applied by the said solenoid pole piece means upon said second lever arm portion as multiplied by the effective respective lengths of said second lever arm portion relative to said first lever arm portion.

3. An electromagnetic unit fuel injector of the type including a pump means to pressurize fuel; a supply/-spill passage means in flow communication with said pump means and having a valve operatively associated therewith for movement between an open position and a closed position to control flow therethrough, a spring means operatively associated with said valve to normally bias said valve to said open position and, a solenoid means including a fixed pole piece means and a movable armature operatively associated with said valve to effect movement thereof to said closed position: the improvement wherein said armature is in the form of a rocker arm and includes a first lever arm portion operatively associated with said valve, an intermediate fulcrum portion pivotally positioned in abutment against a fixed element of said pole piece means and a second lever arm portion, of a length greater than said first arm portion, and wherein said pole piece means includes a U-shaped core having one leg thereof associated with said first lever arm portion and having its other leg associated with said second lever arm portion so as to define a pair of working air gaps of substantially equal areas whereby upon energization of said pole piece means, said second lever arm can be attracted to said pole piece means to effect movement of said valve to said closed position via said first lever arm, by a force greater than the attractive force applied by the said solenoid pole piece means upon said second lever arm portion as multiplied by the effective respective lengths of said second lever arm portion relative to said first lever arm portion.

* * * * *